United States Patent [19]

Crane, Jr.

[11] Patent Number: 4,932,902

[45] Date of Patent: Jun. 12, 1990

[54] ULTRA-HIGH DENSITY ELECTRICAL INTERCONNECT SYSTEM

[75] Inventor: Stanford W. Crane, Jr., Cincinnati, Ohio

[73] Assignee: Crane Electronics, Inc., Cincinnati, Ohio

[21] Appl. No.: 326,302

[22] Filed: Mar. 21, 1989

[51] Int. Cl.[5] ..... H01R 13/00

[52] U.S. Cl. ..... 439/627

[58] Field of Search ..... 439/284, 290, 291, 627, 439/678, 907

[56] References Cited

U.S. PATENT DOCUMENTS 4,655,517 4/1987 Bryce .
4,682,839 7/1987 Bryce .

FOREIGN PATENT DOCUMENTS 680315 2/1964 Canada ..... 439/678
1115465 1/1956 France ..... 439/678

OTHER PUBLICATIONS

Rib-Cage Connector (pp. 468 & 469).
Molex advertisement.
Robinson Nugent PAK-50.
Aries Catalog PG-987.
COMPAQ advertisement.
*Ultra-High Density Electrical Interconnect System*, patent application, pp. 1-5 and p. 6, lines 1-23.
Rib-Cage Connectors; *Connector Design Guide*; p. 52.
AMPMODU 50 connector ad.

*Primary Examiner*—Joseph H. McGlynn
*Attorney, Agent, or Firm*—Wood, Herron & Evans

[57] ABSTRACT

An ultra-high density electrical interconnect system is described wherein the pins and sockets are generally triangular in cross-section. This configuration allows for a density of 400 or more contacts per square inch wherein the contacts are supported on a grid pattern having 50 mil or less spacing between intersections. Further, the substrate supporting the contacts need be no wider than 50 mil per row of contacts. Still further, at least three rows and columns of contacts may be provided with the 50 mil or less spacing.

36 Claims, 4 Drawing Sheets

ULTRA-HIGH DENSITY ELECTRICAL INTERCONNECT SYSTEM

BACKGROUND OF THE INVENTION

This invention relates to electrical interconnect systems such as electrical connectors or the like.

Many types of electrical interconnect systems are employed for interconnecting electrical and electronic systems, and subsystems, and components thereof. In such systems, interconnection is usually accomplished by inserting an electrical pin into an electrical socket thereby electrically coupling two system locations such as circuit junctions, semiconductor device terminals or the like.

An example of one such interconnect system is a pair of components such as electrical connectors each one of which has an insulator body supporting electrical contacts to be mated with the electrical contacts of the other. One of the connectors may have square or round cross-section pins to mate with similar cross-section sockets associated with the other connector. The contacts (pins and/or sockets) may be supported within the channels of an insulative housing such as the connector shown in U.S. Pat. No. 4,682,839 assigned to the assignee hereof, or they may be received through and supported in apertures formed in an insulative substrate. With respect to pins, one end of the pin may extend from the substrate or housing for mating connection with a socket, while the back end of the pin may be joined to a wire of a cable or to an electrical conductor or trace formed in or on the substrate. Alternatively, the back end of the pin may also extend from the substrate for connection to another substrate such as a printed circuit board as seen in U.S. Pat. No. 4,655,517, also assigned to the assignee hereof. With respect to sockets, the mouth of the sockets may be situated adjacent the front wall of the substrate or housing. The back end of the socket may be joined to a wire, conductor or another substrate as in the case of a pin.

As will be appreciated, the electrical contacts must be supported by the pair of connector components in complementary arrangement so that when two connectors are joined together, each pin will be aligned with and be received in a respective socket. To this end, one conventional approach is to position each electrical contact such that its longitudinal axis passes through the intersection of an imaginary square or rectangular grid or matrix on a surface of the substrate to form evenly dispersed rows and columns of pins or sockets. The electrical contacts of a connector must, however, be spaced far enough apart from one another to ensure that there is sufficient insulator housing or substrate material or "real estate" to properly support each contact. To this end, a common arrangement has been to select a square grid having 100 mil (0.100 inch) spacing between adjacent intersections in each row and each column. With a 100 mil by 100 mil square grid arrangement, the centerline of each row of contacts is spaced 100 mil from the next. Furthermore, the centerline or longitudinal axis of each contact in a row is spaced 100 mil from the longitudinal axis of an adjacent contact in that row. This type of arrangement results in a connector having a density of not more than 100 contacts per square inch in that the longitudinal axis of each electrical contact is spaced 100 mil from any adjacent electrical contact in the row and/or column.

As electronic components are made to operate at ever-increasing speeds, and are made in ever smaller dimensions, efforts are needed to increase the density of the contacts in the interconnect system. To this end, various suggestions have been made which increase the density to about 200 contacts per square inch. One suggestion has been to reduce the spacing between contact axes in each row to 50 mil while maintaining spacing between the row centerlines at 100 mil. The result is a rectangular grid with a density of about 200 electrical contacts per square inch. Another suggestion has been to offset every other row to define a diamond-shaped grid with the spacing between contact axes in each row maintained at 100 mils but the spacing between row centerlines reduced to 50 mil. The diamond grid arrangement also provides a density of up to 200 electrical contacts per square inch.

Even greater density is needed. In particular, a density of at least 400 contacts per square inch (e.g., with not more than a 50 mil by 50 mil grid) is desired. Apparently, efforts to reduce contact spacing in both directions, i.e., to a square grid with 50 mil or less spacing, have not met with much success. As is well recognized, pins must have some finite dimension to them so that they retain their structural integrity when in use. Conventionally, such pins are round or square in cross-section and may have a diameter of more than 18 mil and, typically, 25 mil when round or a dimension of more than 25 mil by 25 mil when square. Similarly, the sockets must have a hole diameter about equal to or larger than the cross-section of the connecting end of the pin to be received therein. Sockets may typically also include resilient walls or wiper arms which expand or are urged outwardly from the axis of the socket by the pin as it is inserted into the socket to thereby grip the pin. The resilient arms or expanded walls maintain normal force against the pin to provide the electrical interconnection. However, the area of connector substrate devoted to the socket must take into account such movement or expansion of the socket mechanism. Furthermore, a certain amount of substrate material or real estate must surround the socket so that it is supported for use and isolated from adjacent sockets. Consequently, more than a 50 mil by 50 mil area of connector real estate may be devoted to each socket, thereby placing a lower limit on spacing or substrate real estate between contacts.

There is a connector that achieves a 400 contact per square inch (50 mil by 50 mil) density. However, that connector is believed to be deficient in many respects. The connector is limited to, at most, two rows of contacts. The area outboard of the two rows must be made sufficiently large to accommodate the socket such that addition of a third row of contacts within 50 mil of either of the two rows is not believed to be possible. Moreover, the insulative support real estate outboard of the rows (or outboard of a single row where only one row of contacts is used) must be wider than 50 mil per row of contacts (measured transverse the row). Consequently, the connector itself cannot be "stacked" to simulate a multi-row connector having 50 mil row spacing throughout. Still further, the particular way in which the 400 contact per square inch density is achieved results in extremely high insertion force requirements and tolerance build-up problems which can lead to binding or stubbing. As a practical matter, the number of contacts which may be supported and used by such a connector is believed to be limited to about 50, thus failing to take full advantage of the density of that connector.

Merely reducing the cross-section dimension of the contacts to achieve greater density is not believed to be acceptable as structural integrity of the pins and/or sockets may suffer, especially if such reductions are attempted in an effort to achieve a density of at least 400 contacts per square inch and with a connector having an insulative substrate which is no wider than 50 mil per row of contacts. Thus, it is believed that further increase in contact density with currently available contacts would leave too little substrate material (real estate) to properly support the contacts for their intended use.

SUMMARY OF THE INVENTION

The present invention overcomes limitations inherent in the prior art to provide an electrical interconnect system having a realizable density of at least 400 electrical contacts per square inch with a substrate no wider than 50 mil per row of contacts (measured transverse the row) and/or having at least three rows and columns of contacts. With the present invention, a grid pattern defining the rows and columns of contacts may have intersections spaced 50 mil or less apart so that the electrical contacts in each row and column may be spaced 50 mil or less apart on center, while still providing sufficient substrate real estate and structural integrity of pins and sockets.

In accordance with the principles of the present invention, and in its broadest aspects, such density is accomplished by utilizing pins having a cross-section shaped to provide structural integrity to the pins while at the same time reducing the amount of connector real estate taken by the similarly-shaped socket channels receiving the pins so as to effectively increase the spacing between adjacent contacts even though not more than a 50 mil center grid is utilized. Thus, a large number of rows of contacts may be achieved and the full 400 or more contact density realized. Further, even where one row only is provided, the width of the substrate need not be more than 50 mil wide measured transverse the row. By virtue of the present invention, therefore, the density of contacts is thus greatly increased over the prior art without sacrificing either structural integrity or performance of the contacts or substrate support therefor.

In accordance with one aspect of the present invention, the portion of a pin to be received in a socket has a hypotenuse wall and one or more contiguous back walls extending between the edges of the hypotenuse wall to define a generally triangular cross-section. Preferably, there are two back walls which adjoin one another to define a right-angle whereby the cross-section of the pin is right-triangular. Further preferably, the two back walls are equal in width, thus defining an isosceles right-triangular cross-section. With a generally triangular cross-section, the pins are sturdy and will not easily lose structural integrity.

Similarly, the sockets are provided with a mouth channel section having an hypotenuse wall and a pair of backwalls to define a generally triangular cross-section to receive the pins therein and therethrough for guiding and alignment of the pins. Further, the socket may include a rear channel section behind the mouth channel section to define an enlarged region situated adjacent a plane defined by the hypotenuse wall of the triangular mouth channel section. The electrical interconnection may be accomplished in this enlarged region by a resilient wiper arm, for example. Thus, the electrical interconnection may occur in the area which would normally have been occupied by the pin were it round or square in cross-section as was conventional. Consequently, the geometric relationships provided by using triangular pins advantageously maximizes substrate real estate allowing the pins and sockets to be spaced more closely together, with less real estate outboard of the rows and/or with more rows and columns than is believed to have been previously achieved in the prior art.

In accordance with a further aspect of the present invention, the pins and/or sockets are arranged in their respective substrates or housings such that the hypotenuse walls thereof are all parallel one another. In this configuration, the interconnect system is automatically polarized and has a wide variety of possible configurations. Furthermore, and as preferred, the hypotenuse walls are all diagonally disposed relative the grid pattern such that maximum spacing is found between two contacts on a diagonal, i.e., along a line which is perpendicular the hypotenuse wall of one contact. To take advantage of this relatively large area, the sockets of the present invention preferably include only a single interconnecting arm movable in this area (the enlarged region of the rear channel section) for electrical interconnection to the pin. Preferably, the arm has a portion which is bent inwardly to and adjacent the back walls of the socket. The arm is further preferably resiliently supported by a base which is adjacent the plane of the socket hypotenuse wall. As a pin is inserted into the socket, the wiper arm will be urged outwardly along a line perpendicular the hypotenuse wall of the contact and into the enlarged region, rather than directly towards adjacent contacts in the same row and column.

In accordance with a yet further aspect of the present invention, substantial normal force between pin and wiper arm may be achieved. In this regard, the wiper arm may be biased such that it normally approaches or touches the back walls of the socket. Thus, as a pin is inserted into the socket, the wiper arm is urged outwardly a distance equal to the height of the triangular mouth allowing a relatively low insertion force while giving the high normal force desired between socket and pin to provide a reliable electrical connection therebetween. To this end, the forwardly end of the pin in the present invention is preferably configured with a camming wall extending between the hypotenuse wall of the pin and the very tip of the pin. The tip is defined at or near the right angle corner of the pin to provide maximum surface area for the camming wall. As the pin is inserted into the socket, the shape of the pin forwardly end causes the wiper arm to first be engaged along the pin camming wall to thereby avoid stubbing. Thereafter the wiper arm is urged outwardly against its normal spring tendencies so it rides along the pin camming wall. After the pin is fully inserted, the wiper arm will bear against the hypotenuse wall of the pin to apply substantial normal force and large contact surface whereby to provide reliable electrical interconnection between pin and socket.

These and other objects and advantages of the invention shall be made more apparent from the accompanying drawings and the detailed description thereof.

BRIEF DESCRIPTION OF THE DRAWINGS

The accompanying drawings, which are incorporated in and constitute a part of this specification, illustrate an embodiment of the invention and, together with a general description of the invention given above and the detailed description of the embodiment given below, serve to explain the principles of the invention.

DETAILED DESCRIPTION OF THE DRAWINGS

Figure 1:
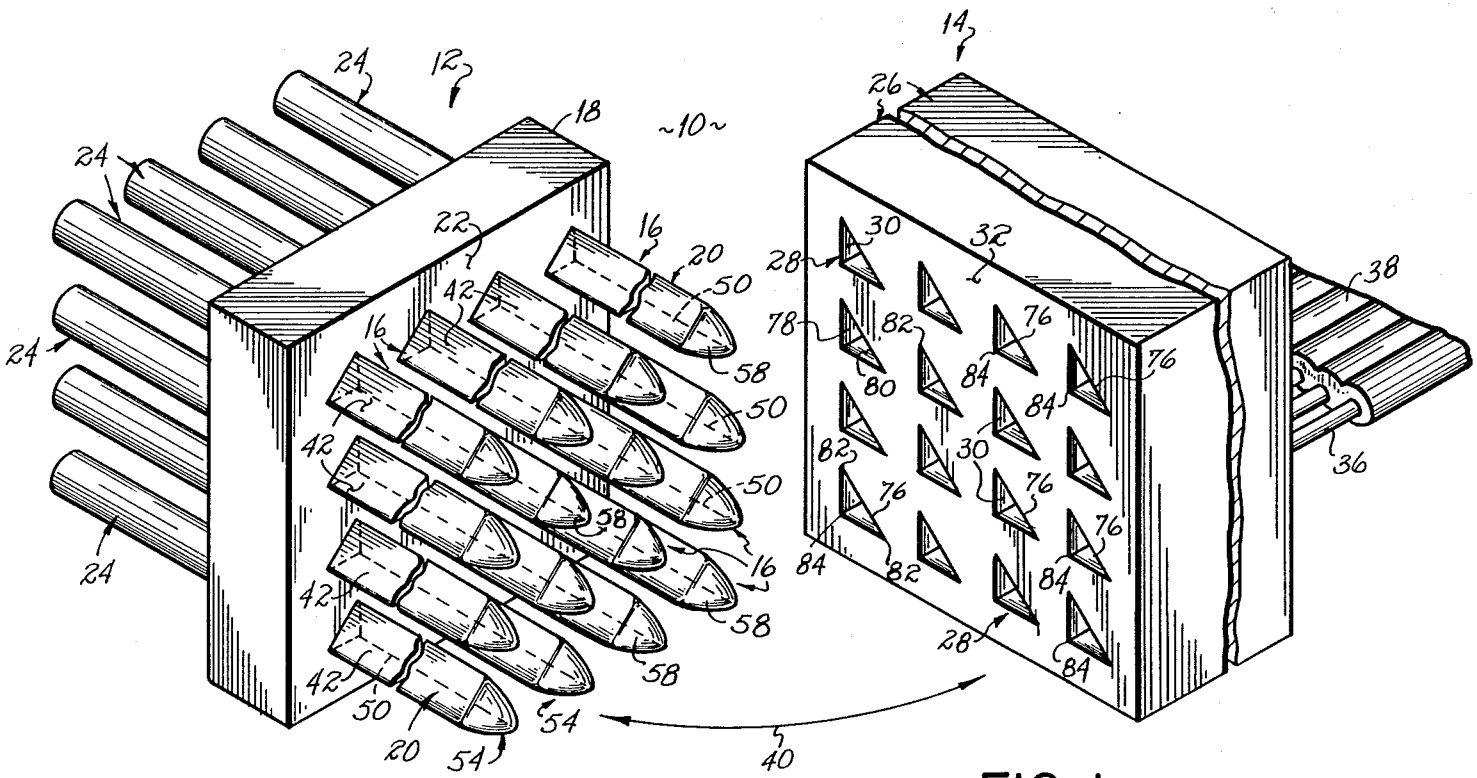
FIG. 1 is a perspective view of an electrical interconnect system utilizing two connectors for purposes of explaining the principles of the present invention.

With reference to FIG. 1, there is shown a two-component electrical interconnect system 10 represented by a first connector component 12 and a second connector component 14. Connector 12 includes a plurality of electrical contacts such as pins 16 supported by an insulative substrate 18. Connecting ends 20 of pins 16 extend forwardly from the front face 22 of substrate 18 for mating with connector 14 as will be described. Similarly, back ends 24 of pins 16 extend rearwardly from substrate 18 for connection to wires (not shown) or another substrate (also not shown) as is conventional. Connector 12 could alternatively be a printed circuit board, a pin grid array for an integrated circuit, a connector housing or the like.

Similarly, connector 14 includes an insulative housing 26 supporting a plurality of contacts such as sockets 28. Each socket 28 has a forwardly opening 30 coplanar with front face 32 of housing 26 through which is receivable connecting end 20 of a pin 16. Each socket 28 is coupled at its back end in conventional manner as at 34 (FIG. 7A) to a wire 36 of a multi-wire cable 38. Connector 14 could, alternatively, be a connector substrate (such as in the case of connector 12), a pin grid array for an integrated circuit, a printed circuit board, or the like. As will be appreciated, pins 16 and sockets 28 are supported by the respective connectors 12, 14 in a complementary fashion so that connectors 12 and 14 may be matingly joined as indicated by arrow 40 whereby the connecting end 20 of each pin 16 will be properly aligned with and mate into a respective socket 28.

Prior attempts to increase contact density are believed to have been limited to either about 200 contacts per square inch or to require an insulator that is more than 50 mil wide per row of contacts, and with a limit of not more than two rows of contacts. In accordance with the principles of the present invention, and as will now be described, the unique shape of pins 16 and sockets 28 permits connectors 12, 14 to support contacts 16, 28 with a density of at least 400 contacts per square inch such that a row of contacts is supported within a housing that is no more than 50 mil wide (or multiple rows with a housing width not more than that same multiple of 50 mil). Further, at least three rows and columns of contacts may be supported.

Figure 2:
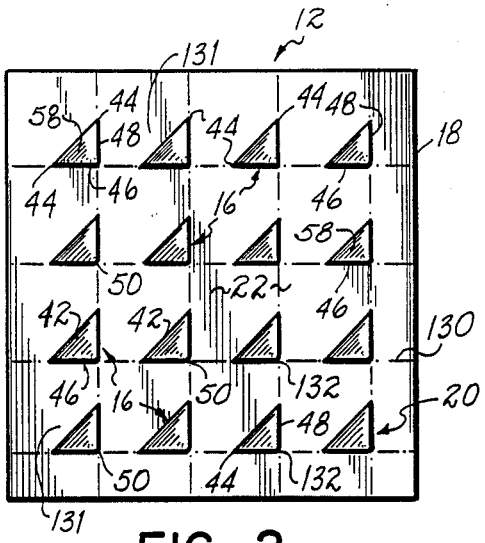
FIG. 2 is a front plan view of one of the connectors of the interconnect system of FIG. 1.
Figure 3:
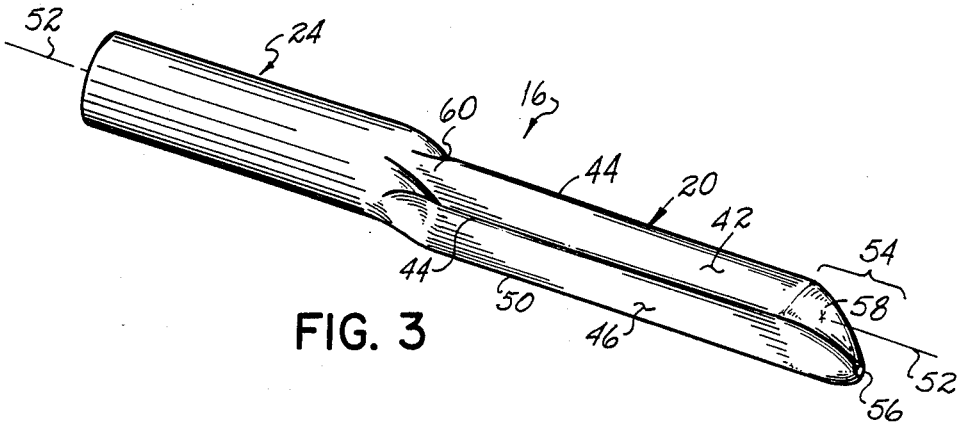
FIG. 3 is an isometric view of a pin of the connector of FIG. 2.
Figure 4:
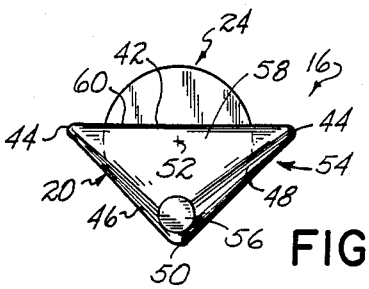
FIG. 4 is an enlarged front plan view of the pin of FIG. 3.
Figure 8:
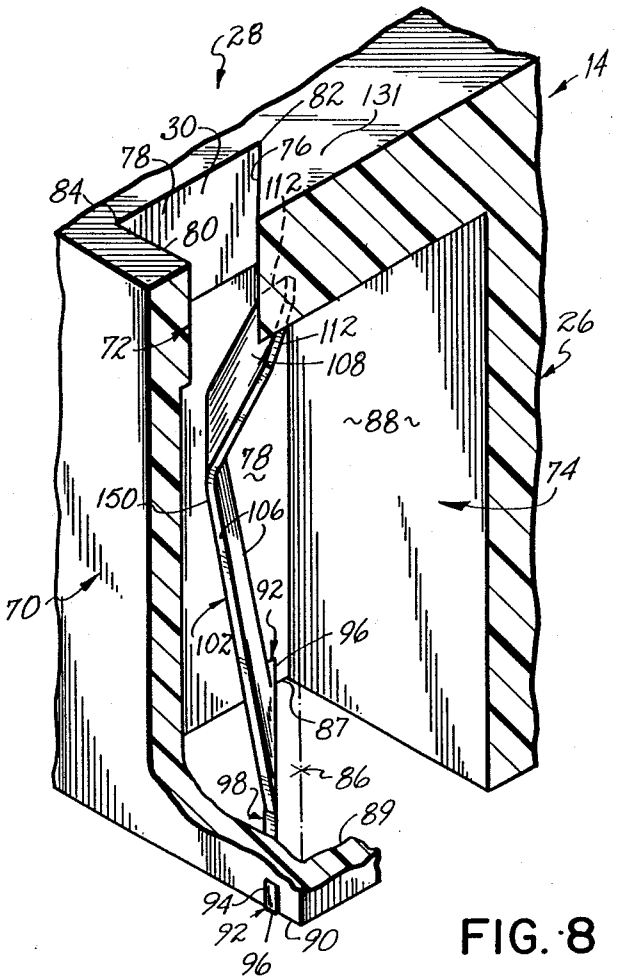
FIG. 8 is a partial cross-sectional view of the socket of the present invention.

With specific reference to FIGS. 2–4, the unique shape of elongated metal pins 16 may be seen. In particular, connecting end 20 of each pin is primarily bounded by a hypotenuse wall 42, the edges 44 of which adjoin a respective back wall 46, 48. Preferably, back walls 46, 48 adjoin along corner line 50 generally parallel a longitudinal axis 52 of pin 16 to preferably define a right angle. Further preferably, back walls 46, 48 are equal in width such that the cross-section of pin end 20 is substantially defined by an isosceles right triangle. At the terminus 54 of pin end 20 is a flat, round-edged tip 56 spaced about 6 mil from corner line 50 and a sloping wall 58 extending between tip 56 and hypotenuse wall 42 and back walls 46, 48 to define a camming surface for purposes to be described hereinafter.

Pin 16 also includes a back end 24 coupled at a transition 60 to end 20. Back end 24 may be circular in cross-section for mating with a printed circuit board for example. In the embodiment described, back end 24 has a diameter of 18 mil and back walls 46 and 48 are each 22.5 mil wide. Back end 24 and connecting end 20 are joined at transition 60 such that the periphery of back end 24 does not extend beyond the planes of back walls 46, 48.

A mating socket 28 of connector 14 will now be described with reference to FIGS. 5–8. Socket 28 is defined by a channel 70 extending into substrate or housing 26. Channel 70 has a 20 to 30 mil deep mouth section 72 extending between opening 30 and a 80 to 150 mil deep rear channel section 74. Mouth section 72 is configured to matingly receive a pin end 20 therethrough. Hence, mouth section 72 is also generally triangular in cross-section and is defined between a hypotenuse wall 76 and a pair of contiguous back walls 78, 80 extending between edges 82 of hypotenuse wall 76. Back walls 78 and 80 preferably adjoin along corner line 84 generally parallel a longitudinal axis 86 of channel 70 to define a right angle such that the cross-sectional shape of mouth section 72 is right-triangular. Further preferably, back walls 78, 80 are equal in width to define an isosceles right triangle cross-section. In the embodiment described, back walls 78 and 80 are each about 27–29 mil wide.

Mouth section 72 communicates with a rear channel section 74 defined by four contiguous 35–36 mil wide walls 87–90 to define a rectangular or square cross section. Each of walls 87 and 90 are generally parallel and spaced outwardly 2–3 mil of the plane of a respective mouth section back wall 78 and 80. Also, formed in each of walls 87 and 90 is a diagonal notch 92 the forwardly edge 94 of which is in the plane of hypotenuse wall 76 for purposes to be described hereinafter.

Received in notches 92 are barbed, lateral edges 96 of a metal base plate 98. Extending rearwardly from and integral with base plate 98 is a contact post 100 for connection to wire 36 at 34 as is conventional. Extending upwardly from and integral with base plate 98 is a resilient wiper arm 102 which generally is about 10–20 mil shorter in its formed state than the depth of rear channel section 74. Arm 102 has generally an S-shape to it when viewed from the side as in FIGS. 7A–7C and 8. Arm 102 has an upper finger portion 104 which is normally biased toward walls 87 and 90 so that respective lateral edges 106 of finger 102 are normally spaced adjacent walls 87 and 90 and appear to touch walls 78 and 80 of mouth section 72 (see FIG. 6).

Arm 102 further includes a stub end 108 at which finger 104 terminates. Stub end 108 extends beyond the plane of hypotenuse wall 76 and into region 110 of rear channel section 74 so that downward contact of a pin end 20 with finger 104 through mouth section 72 will cause arm 102 to deflect rather than stub or stall. To this end, the angle of camming wall 58 between hypotenuse wall 42 and corner line 50 measured through axis 52 is preferably greater (by about 10°) than the angle between finger 104 and a plane perpendicular hypotenuse wall 76 when arm 102 is at rest as in FIG. 7A. Further, stub end 108 is shaped, i.e., its lateral edges 112 converge so that arm 102 may be urged completely outwardly from the area below mouth section 72 as a pin end 20 is received thereagainst before stub end 108 impacts walls 88 or 89 of rear channel section 74. However, coaction or interference of stub end 108 and walls 88, 89 beyond that point acts as an anti-overstress to prevent damage to arm 102.

Figure 6:
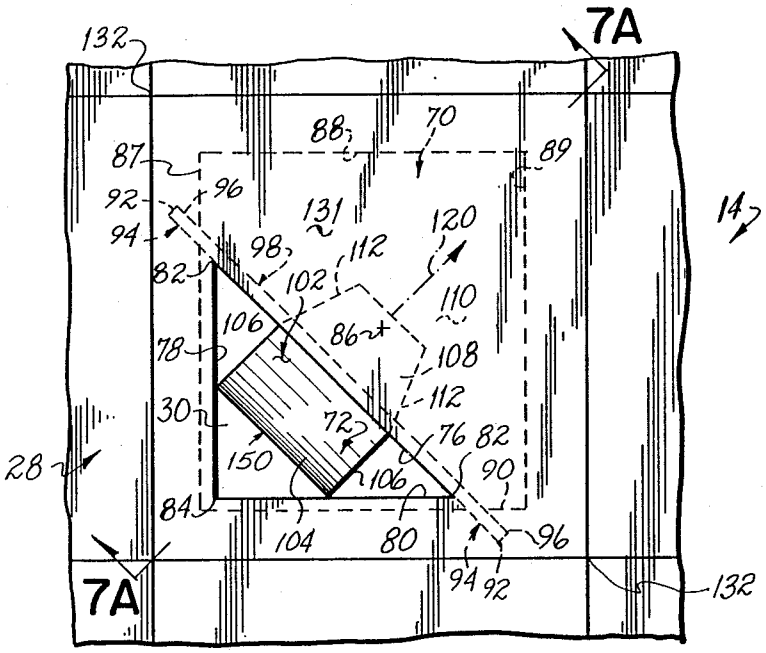
FIG. 6 is an enlarged front plan view of a portion of the connector of FIG. 5.
Figure 7A:
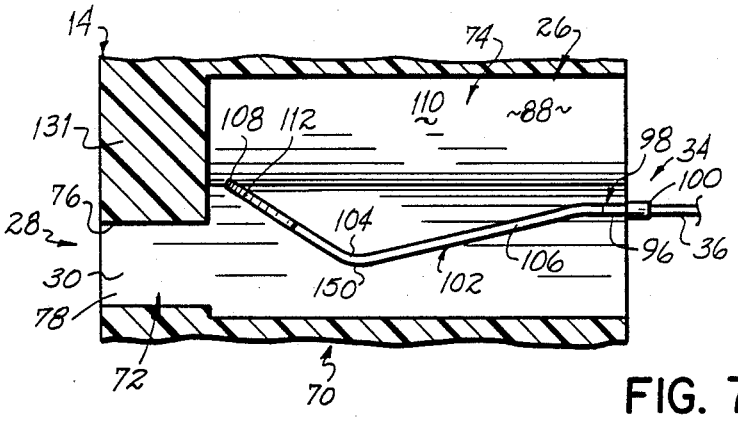
FIG. 7A is a cross-sectional view taken along lines 7A—7A of FIG. 6.
Figure 7B:
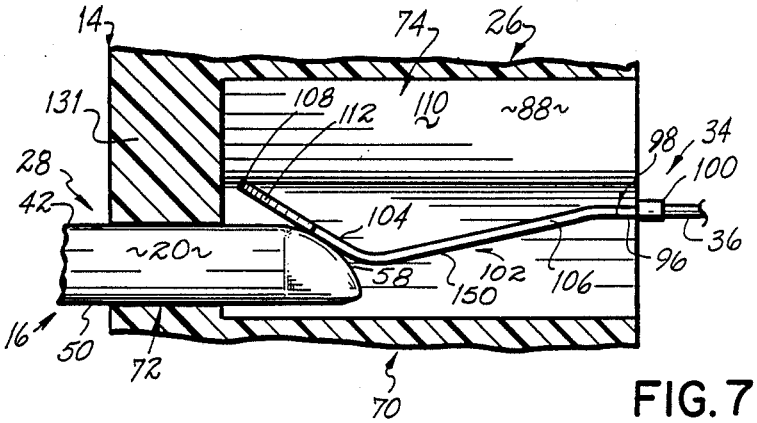
FIGS. 7B and 7C are figures similar to FIG. 7A showing the pin of FIG. 3 being received in a socket of the connector of FIG. 5 to illustrate the present invention.
Figure 7C:
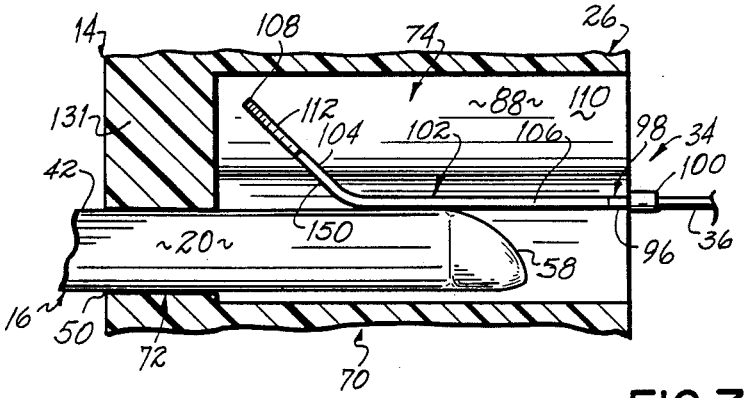

In operation, arm 104 is normally biased towards walls 87, 90 so that finger 104 underlies or partially occludes mouth section 72 (see FIGS. 6 and 7A). As end 20 of a pin 16 is matingly received through mouth section 72 of socket 28 (see FIG. 7B), camming wall 58 of pin 16 will bear against finger 104 of arm 102 so as to urge arm 102 outwardly in a line generally perpendicular hypotenuse wall 76 of socket 28 as indicated by arrow 120 (FIG. 6). Eventually hypotenuse wall 42 of pin 16 will engage finger 104 whereupon pin 16 may be fully inserted into socket 28 so that pin end 20 is situated within rear channel section 74. Preferably, and to achieve the desired interconnection, arm 102 is substantially vertical when pin 16 is fully inserted into socket 28 as seen in FIG. 7C (and walls 112 of stub 108 are adjacent walls 88, 89 for anti-overstressing) such that wiper arm 102 may be seen as an extension of hypotenuse wall 76 of socket 28 and be said to lie therealong. Thus, socket 28 may be described as having a generally triangular cross-section. This is achieved by the positioning of diagonal notches 92 to support the base 98 of arm 102 so that edges 94 are in the plane of hypotenuse wall 76.

By virtue of the foregoing, only a single easily moved or flexed part is needed in the present invention to make good electrical connection between pin and socket. Hence, the insertion force required to insert a pin is relatively low allowing for an interconnect system having hundreds of simultaneous mating interconnections (pin to socket engagement). Further, after pin 16 is inserted, wiper arm 102 and base 98 thereof are generally in one plane and thus use very little real estate to function. Indeed, movement of wiper arm 102 occurs in region 110 which would otherwise have been at least partially dedicated to receiving the pin end with prior art round or square pins. Were a prior art round or square pin utilized, that would have necessitated use of more real estate between sockets 28 (e.g., thinner walls 87–90) to allow for the interconnecting arm to flex beyond current walls 88 and 89 of the socket of the present invention.

With the present invention, therefore, another socket 28 may be placed closer to socket 28 than would otherwise be expected. That is, due to the triangular cross-sectional shape of connecting end 20 of pins 16 and related sockets 28, the electrical contacts may be positioned in a 50 mil by 50 mil (or less) square grid of multiple rows and columns represented by broken lines 130 in FIGS. 2 and 5, while leaving sufficient connector real estate, such as substrate material 131, to support the structurally sound contacts. The grid defined by lines 130 includes a plurality of intersection points 132 spaced at 50 mil or less (as small as 1 mm with slightly smaller pins and sockets) intervals in each horizontal row and vertical column. The corner line (50 or 84) of each contact is perpendicular to and passes through a respective intersection point 132. Each contact is thus spaced on 50 mil or less centers in each row, and the center line of each row is spaced 50 mil or less from each adjacent row to provide an interconnect system wherein each component has a density of at least 400 electrical contacts per square inch. Additionally and advantageously, the width of the substrate measured transverse the rows (vertically in FIGS. 2 and 5) need be no more than 50 mil times the number of rows of contacts. Thus, each contact fits within a 50 mil by 50 mil area of real estate as represented in FIG. 6.

Further advantageously, the pin and socket arrangement of the present invention presents such an ultra-high density of contacts with contacts that may be mated without the substantial insertion force required of the prior art connector having a similar density. Thus, contacts may be provided in rows and columns so that such contact density may be realized with several or several hundred contacts per component, but in a smaller space than previously believed to have been achieved.

Figure 5:
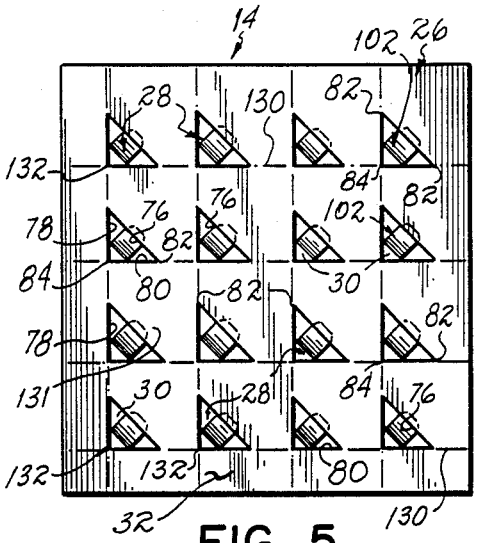
FIG. 5 is a front plan view of the other connector of the interconnect system of FIG. 1.

In accordance with a further aspect of the invention, each contact is rotated in the same direction on its respective component such that each hypotenuse wall thereof is diagonally disposed relative the grid and in a plane shared with or parallel every other hypotenuse wall on that connector. Hence, a common point selected on any contact will be spaced 50 mil or less from the same common point on an adjacent contact in the same row or in the same column. Other configurations may be provided such as providing the pins or sockets in groups of four whereby the four hypotenuse walls thereof face towards a common center (not shown). However, the arrangement shown in FIGS. 2 and 5 is preferred in that it provides for automatic polarization between connectors 12 and 14. That is, if one were to attempt to mate connectors 12 and 14 and one of them is rotated relative the other rather than in the orientation shown in FIG. 1, the pins would not fit into the sockets in which event proper electrical interconnection could not be made. Still further, with the arrangement of the present invention, i.e., parallel hypotenuse walls, the number of rows or columns which may be provided in any given interconnect system will not interfere with uniformity. This provides maximum versatility in terms of width and length of the connector and aids in automation of assembly.

In accordance with a yet further aspect of the present invention, the unique cross-section of the contacts of the present invention advantageously provide substantial normal force between wiper arm 102 and pin 16 to maintain a reliable electrical interconnect therebetween. As is known, as a lever is caused to move against its bias, the greater the force it exerts against any surface holding it against that bias. This phenomenon is advantageously employed in the present invention. As there is only one moving part of socket 28, wiper arm 102 may be normally biased to pass through virtually the entire area within socket 28 below mouth section 72 (through its entire height) rather than just a slight portion thereof as would be the case if multiple wiper arms were provided as usually occurs with round or square contacts. Thus, substantial leverage and normal forces are obtained. Electrical interconnection is still further enhanced due to the cross-sectional shape of the contacts. In this regard, electrical interconnection is possible between wiper arm 102 and pin 16 across the almost 32 mil width of pin hypotenuse wall 42 rather than at points about a round pin or the shorter sidewalls of a square pin as would be conventional.

Although pins 16 are shown having a generally circular back end 24, other configurations may be employed. Back end 24 as shown is selected to mate with an aperture in a printed circuit board, for example. Back end 24 could, alternatively, be triangular in cross-section as well for connection to a second connector like connector 14 having similarly shaped and densely packed sockets. Similarly, contact post 100 of socket 28 could, alternatively, be shaped similar to connecting end 20 of pins 16 for connection to a further socket 28. Arm 102 is shown as having a generally flat outer contour 150 for contacting pin 16 (FIG. 8), however, an arcuate surface could be provided. Further, arm 102 is shown as an elongated, substantially uniform width strip (except at stub end 108); to reduce normal forces, arm 102 could have small edge cutouts along its length. This may be useful where, for example, pins 16 are gold or gold plated. Only 80 grams of normal force may be required in that case whereas arm 102 may normally exert more than the 280 grams of normal force where tin or tin plated pins are used.

Thus, while the present invention has been illustrated by the description of an embodiment and while the illustrative embodiment has been described in considerable detail, it is not the intention to restrict or in any way limit the scope of the appended claims to such detail. Additional advantages and modifications will readily appear to those skilled in the art. For example, although pins 16 and sockets 28 are shown as having an isosceles right-triangle cross-section, other generally triangular cross-sections may be employed. However, each pin must have sufficient cross-sectional area to provide structural integrity. Further, the contacts must have the equivalent of a hypotenuse wall (e.g., a wall disposed generally diagonally of the grid orientation) to result in providing a region 110 within socket 28 for the moving wiper arm or similar electrical interconnect as done by the triangular pins and sockets described herein. Thus, other possible contact configurations may include a crescent-moon shape such as where the pair of back walls have no discontinuity as along corner line 50 and instead merge into a single generally arcuate convex wall, for example. The invention in its broader aspects is therefore not limited to the specific details, representative apparatus and method, and illustrative examples shown and described. Accordingly, departures may be made from such details without departing from the spirit or scope of the general concept.

What is claimed is:

1. A component for an ultra-high density electrical interconnect system comprising:

a substrate;

a plurality of electrical contacts supported by the substrate in a generally rectangular grid pattern to define at least one row and plural columns of contacts, each contact having a hypotenuse wall and adjoining back wall means to define a generally triangular cross section thereto, adjacent contacts in each row being spaced apart not more than about 50 mil, the substrate having a width measured transverse the row of contacts and along each column not more than 50 mil times the number of rows of contacts supported by the substrate.

2. The component of claim 1, at least some of the contacts each being an electrical pin projecting from the substrate and having said hypotenuse wall and adjoining back wall means to define a generally triangular cross-section of the pin.

3. The component of claim 1, each hypotenuse wall being disposed generally diagonally relative the generally rectangular grid pattern.

4. The component of claim 1, each hypotenuse wall being generally parallel every other hypotenuse wall.

5. The component of claim 1, the contacts being supported by the substrate to define plural rows of contacts, whereby there are plural contacts in each of the plural columns, adjacent contacts in each column being spaced apart not more than about 50 mil whereby to provide a density of contacts supported by the substrate of about at least 400 contacts per square inch.

6. The component of claim 1, at least some of the contacts each being a socket for receiving an electrical pin, each socket defined within a channel, the channel including a forwardly mouth section through which a pin is received, the mouth section having said hypotenuse wall and adjoining back wall means to define a generally triangular cross-section thereto.

7. The component of claim 6, each socket channel further including a rear section communicating with and larger in cross-section than the forwardly mouth section, each socket further including electrical interconnect means movable in the rear section for electrically interconnecting to an electrical pin whereby the electrical interconnect means is movable within an enlarged region of the rear section outwardly of a plane in which the mouth section hypotenuse wall lies.

8. A component for an ultra-high density electrical interconnect system comprising:

a substrate;

a plurality of electrical contacts supported by the substrate in a generally rectangular grid pattern to define at least three rows and three columns of contacts, each contact having a hypotenuse wall and adjoining back wall means to define a generally triangular cross section thereto, adjacent contacts in each row being spaced apart not more than about 50 mil, and adjacent contacts in each column being spaced apart not more than about 50 mil whereby to provide a density of contacts supported by the substrate of about at least 400 contacts per square inch.

9. The component of claim 8, the back wall means comprising a pair of back walls each of which adjoins a respective edge of the hypotenuse wall and which adjoin one another along a corner line.

10. The component of claim 8, the back wall means comprising a pair of back walls each of which adjoins a respective edge of the hypotenuse wall and which adjoin one another along a right angle corner line.

11. The component of claim 10, the back walls being equal in width whereby to define an isosceles right-triangular cross-section to the contact.

12. An electrical interconnect component comprising:

a substrate;

a plurality of contacts supported by the substrate, each said contact having a hypotenuse wall with opposed left and right edges, a first back wall portion extending at an angle from the left edge of the hypotenuse wall, and a second back wall portion extending at an angle from the right edge of the hypotenuse wall, said first and second back wall portions extending towards and into engagement with one another to define a generally triangular cross-section of the contact.

13. The component of claim 12, said hypotenuse wall being generally planar.

14. The component of claim 12, each contact being supported by the substrate in a generally rectangular grid pattern to define rows and columns of contacts, adjacent contacts in each row being spaced apart not more than about 50 mil, and adjacent contacts in each column being spaced apart not more than about 50 mil whereby to provide a density of contacts supported by the substrate of about at least 400 contacts per square inch.

15. The component of claim 14 having at least three rows and three columns of contacts.

16. The component of claim 14, each hypotenuse wall being disposed generally diagonally relative the generally rectangular grid pattern.

17. The component of claim 14, each hypotenuse wall being generally parallel every other hypotenuse wall.

18. An electrical pin for an ultra-high density electrical interconnection system, comprising:

an elongated metal member bounded by a hypotenuse wall with opposed left and right edges, a first back wall portion extending at an angle from the left edge of the hypotenuse wall, and a second back wall portion extending at an angle from the right edge of the hypotenuse wall, said first and second back wall portions extending towards and into engagement with one another to define a generally triangular cross-section of the elongated metal member.

19. The electrical pin of claim 18 further comprising a tip end and a slanted camming wall extending between the hypotenuse wall and the tip end, the tip end being spaced away from a plane in which the hypotenuse wall lies.

20. The electrical pin of claim 18, the back wall portions engaging one another along a corner line.

21. The electrical pin of claim 18, said hypotenuse wall being generally planar.

22. The electrical pin of claim 18, the back wall portions engaging one another along a right angle corner line.

23. The electrical pin of claim 22, the back wall portions being equal in width whereby to define an isosceles right-triangular cross-section to the elongated metal member.

24. A socket for an ultra-high density electrical interconnect system, comprising:

a housing;

channel means in the housing for receiving therein an electrical pin, the channel means including a mouth section having a hypotenuse wall with opposed left and right edges, a first back wall portion extending at an angle from the left edge of the hypotenuse wall, and a second back wall portion extending at an angle from the right edge of the hypotenuse wall, said first and second back wall portions extending towards and into engagement with one another to define a generally triangular cross-section of the channel means mouth section; and electrical interconnect means in the channel means for electrically connecting to a pin received in the channel.

25. The socket of claim 24, the channel means further including a rear section communicating with the mouth section, the electrical interconnect means being situated in the rear section for electrically connecting to a pin received through the mouth section and into the rear section.

26. The socket of claim 24, the back wall portions engaging one another along a corner line.

27. The socket of claim 24, said hypotenuse wall being generally planar.

28. The socket of claim 24, the back wall portions engaging one another along a right angle corner line.

29. The socket of claim 28, the back wall portions being equal in width whereby to define an isosceles right-triangular cross-section to the mouth section.

30. The socket of claim 24, the channel means further including a rear section communicating with the mouth section, the electrical interconnect means extending into the rear section of the channel means.

31. The socket of claim 30, the electrical interconnect means including a resilient arm extending through the rear section, the arm being normally biased such that a portion of the arm partially occludes access to the rear section through the mouth section, the arm being movable therefrom as a pin is received into the rear section.

32. The socket of claim 31 further including coacting means for anti-overstressing the arm.

33. The socket of claim 32, the coacting means including a wall of the channel means which provides an abutment surface to limit movement of the arm.

34. A socket for an ultra-high density electrical interconnect system, comprising:

a housing;

channel means in the housing for receiving therein an electrical pin, the channel means including a mouth section having a hypotenuse wall and adjoining back wall means to define a generally triangular cross-section thereto, the channel means further including a rear section communicating with and larger in cross-section than the mouth section;

a resilient arm extending through the rear section, the arm being normally biased such that a portion of the arm partially occludes access to the rear section through the mouth section, the arm being movable therefrom as a pin is received into the rear section.

35. The socket of claim 34 further including coacting means for anti-overstressing the arm.

36. The socket of claim 34, the coacting means including a wall of the channel means which provides an abutment surface to limit movement of the arm.

* * * * *